United States Patent [19]

Millington

[11] Patent Number: 4,944,286

[45] Date of Patent: Jul. 31, 1990

[54] IMMERSIBLE WATER HEATER

[76] Inventor: Richard S. Millington, 1823 S. Ash Park La., Boise, Id. 83709

[21] Appl. No.: 415,761

[22] Filed: Oct. 2, 1989

[51] Int. Cl.[5] ..... F24B 9/00

[52] U.S. Cl. ..... 126/367; 126/360 R; 126/73

[58] Field of Search ..... 126/367, 360 R, 73

[56] References Cited

U.S. PATENT DOCUMENTS

| | | | |
|---|---|---|---|
| 410,357 | 9/1889 | Fishbaugh | 126/367 |
| 1,200,349 | 10/1916 | Hemsing | 126/73 |
| 2,695,554 | 11/1954 | Jenson et al. | 98/60 |
| 3,186,402 | 6/1965 | File | 126/360 R |
| 4,455,997 | 6/1984 | Evans et al. | 126/367 |

FOREIGN PATENT DOCUMENTS

| | | | |
|---|---|---|---|
| 723939 | 12/1965 | Canada | 126/367 |
| 201567 | 12/1938 | Switzerland | 126/73 |

*Primary Examiner*—Carroll B. Dority
*Attorney, Agent, or Firm*—Paul F. Horton

[57] ABSTRACT

An immersible water heater for burning solid fuel to heat water contained within hot tubs, tanks, and the like. The heater includes a vertically oriented combined air-fuel intake tube by which the fuel is gravity fed through an unobstructed opening at its lowermost end into a laterally placed combustion chamber. The combustion chamber terminates at its upper end into a chimney having a top opening above the top opening of the air-fuel intake tube to provide an air draft which cools fuel within the intake tube while, at the same time, providing oxygen for combustion within the combustion chamber. Brackets engaging the lip and sides of the tank or tub support the heater in spaced relationship to the sides and bottom of the container to prevent heat damage.

7 Claims, 1 Drawing Sheet

IMMERSIBLE WATER HEATER

BACKGROUND OF THE INVENTION

1. Field of the Invention

This invention relates, in general, to water heating devices, and, more particularly, to solid fuel heaters for outdoor tanks, hot tubs, and the like.

2. Description of the Prior Art

Because electricity and because natural gas and other conventional fuels are many times inaccessible and because of the efficiency in burning wood, coal, pellets, and other solid fuels, it is highly desirable to provide an immersible solid fuel burning heater for heating water in hot tubs, tanks, and other containers.

A number of such water heaters are in existence. The first of such heaters, as typified by U.S. Pat. No. 881,362, issued to A. W. Van Rinsum; U.S. Pat. No. 966,147, issued to E. B. Wills; U.S. Pat. No. 1,268,202, issued to M. E. Anderson; and U.S. Pat. No. 1,468,561, issued to H. A. Friend, were much in the nature of a conventional wood stove having a sealed housing for immersion into a tank. In such heaters, the fuel is loaded directly into the combustion chamber where it is ignited and burned. Such heaters were provided with top opening lids for loading the fuel and for closure during combustion. Similar, were simplified versions in which a single tube served as a fuel reception tube; an air intake tube; and a combustion chamber, as shown by U.S. Pat. No. 1,061,147, issued to Trachte and U.S. Pat. No. 1,329,035, issued to W. S. Bryson. Such versions were plagued by the problems of pulling the heated fumes downwardly, in a direction contrary to natural upward flow of heated gases, and in further pulling the heated gases through the fuel and burned ash. In overcoming these problems, an air conduit, separate from the fuel tube, was provided in heaters invented by S. Anderson and L. Hanson, U.S. Pat. No. 1,187,227 and by D. A. Tisdale, U.S. Pat. No. 1,056,684.

SUMMARY OF THE INVENTION

The present invention is an immersible heater which includes a common air and fuel intake tube; a combustion chamber separate from the intake tube and gravity fed by the intake tube; a chimney having a top opening located above the level of the opening of the intake tube; and brackets for supporting the heater by means of the top lip of the tub or tank and for holding the heater in a spaced relationship relative to the sides and floor of the same.

It is therefore a primary object of the present invention to provide an immersible heater having a fuel intake tube operable to hold solid fuel and to feed the fuel to a combustion chamber separate from the intake tube.

It is another object of the present invention to provide an immersible heater having a combined air intake tube and fuel intake tube whereby air pulled over the fuel prevents fuel within the intake tube from reaching kindling temperature to prevent combustion in the intake tube.

Another object of the present invention is to provide an immersible heater having a top and bottom bracket for suspending the heater from the lip of a tank and for maintaining a spaced relationship between between the heater and the sides and floor of the tank to prevent heat damage.

Still another object of the present invention is to provide an immersible, gravity fed, heater which is provided with a water flow-through tube adjacent the combustion chamber.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
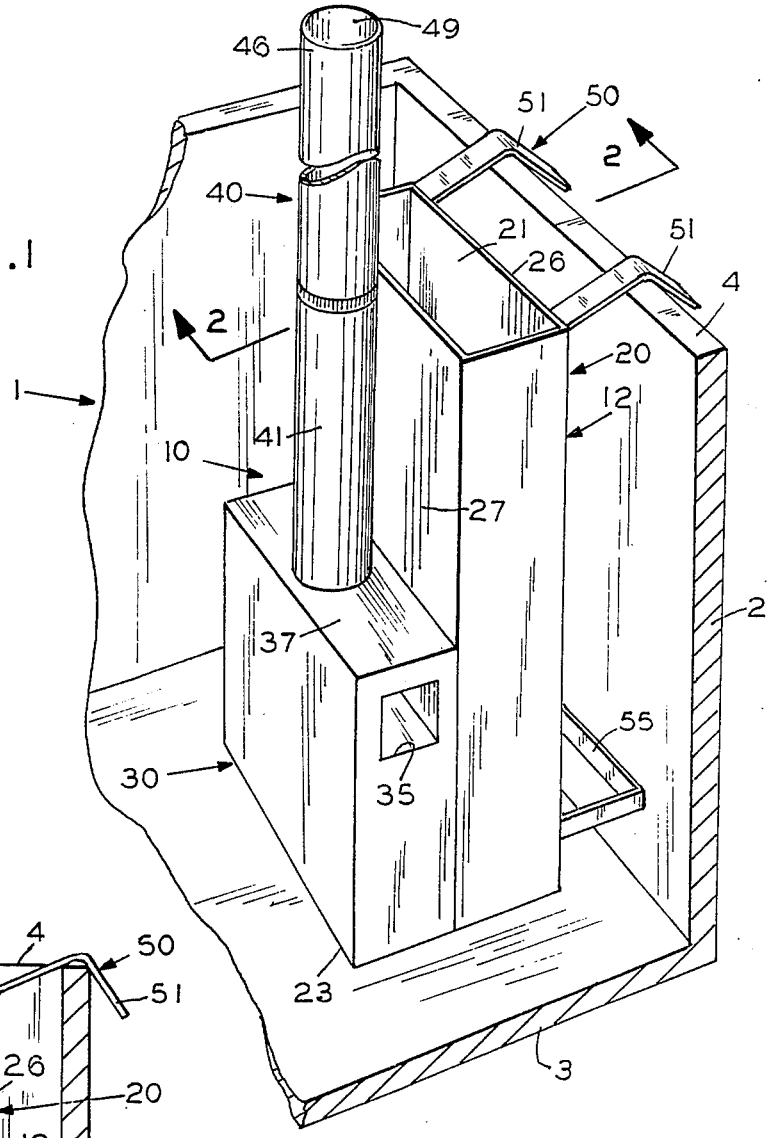
FIG. 1 is a perspective view of a preferred embodiment of the immersible water heater of the present invention, as mounted in a hot tub, shown in outline.
Figure 2:
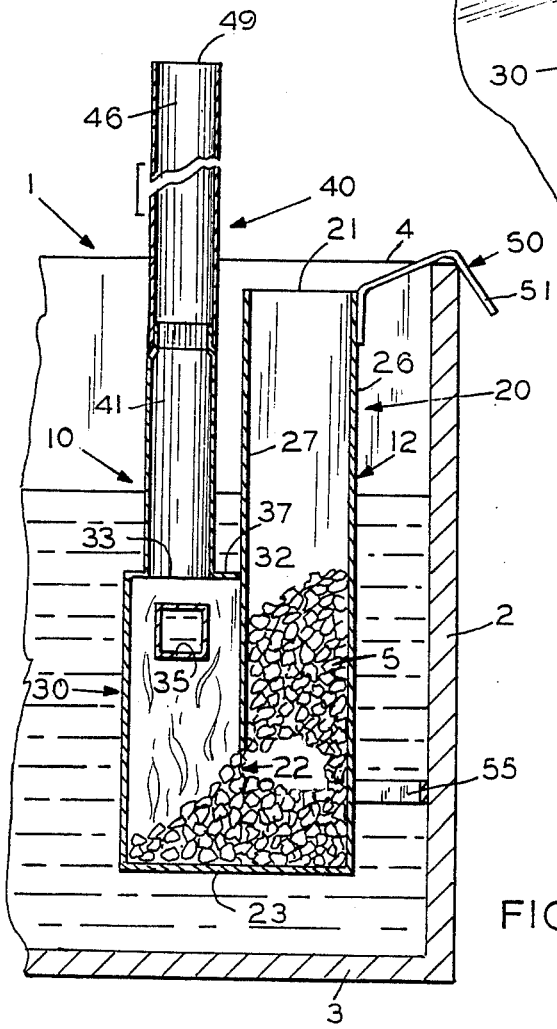
FIG. 2 is a sectional view taken along lines 2—2 of FIG. 1.

Referring now to the drawings, an embodiment to be preferred of an immersible water heater 10 made according to the present invention is disclosed. Heater 10 is provided with a water tight iron or steel housing 12 which defines a combined air and fuel intake tube 20; a combustion chamber 30; and a chimney 40.

Intake tube 20 is an elongated, vertically oriented tube having a top opening 21 for receiving solid fuel and acting as an intake port for air, and a bottom, lateral, unobstructed opening 22. The intake tube terminates at its lowermost end in a base plate 23 which extends across the bottom of the housing, also serving as the floor of the combustion chamber.

Also vertically oriented and parallel with intake tube 20 and in side by side relationship thereto is combustion chamber 30. Chamber 30, in the embodiment shown, is of equal depth and width as the rectangular intake tube 20 and has a height substantially one-half that of the intake tube. The combustion chamber may be welded or otherwise affixed to the intake tube and, in freely opening into the bottom of the intake tube by means of opening 22, defines a baffle 32 which prevents fuel 5 from completely emptying into the combustion chamber until the fuel level reaches the bottom of the baffle, i.e., the top of opening 22. At its uppermost end, the combustion chamber is provided with an outlet port 33 which is in fluid communication with chimney 40. For maximizing heat transference between the combustion chamber and the water into which heater 10 is immersed, housing 12 defines a water flow-through tube 35 at the upper end of the combustion chamber.

Chimney 40 is preferably constructed of two portions. A first portion 41, is integral with and sealingly engages top plate 37 of chamber 30 about outlet port 33 and which extends to a height substantially equal to the height of intake tube 20. A second portion 46, having a top opening 49, may be crimped, as shown, or mounted upon suitable brackets, not shown, for temporary mounting upon first portion 41 to extend the height of the chimney well above opening 21 of intake tube 20. The second portion 46 of chimney 40 adds portability to the heater.

For convenient placement of heater 10 into a hot tub, or other tank 1; to prevent accidental tipping of the heater; and to provide proper space between the heater and the walls 2 and floor 3 of the tank, a first bracket, designated generally by the numeral 50, and a second bracket 55 are provided. First bracket 50 is affixed to the top of wall 26 of air-fuel intake tube 20 and includes a pair of laterally spaced, angled arms 51 which are operable to engage the top rim 4 of the tank. Second bracket 55 is affixed to wall 26, adjacent the bottom of the wall, and extends laterally to engage the interior surface of wall 2 of the tank.

While the heater may be of any dimension and shape to accommodate varying sizes of tubs or tanks, a convenient size for a conventional hot tub includes an air-fuel intake tube, rectangular in cross section, having a height of twenty inches; a width of four inches; and a depth of eight inches. Combustion chamber 30, also rectangular in cross section, has a height of approximately ten inches. Chimney 40 is circular in cross section, having an inside diameter of approximately three inches.

For operation, heater 10 is mounted in tank or hot tub 1, as shown in FIG. 1, with a small amount of fuel in the bottom of the intake tube and combustion chamber. The fuel may be any of a number of solid fuels, such as wood, coal, pellets, or the like, which is of proper size to be gravity fed from intake tube 20 into combustion chamber 30, through opening 22. With the chimney portions properly mounted and in place, fuel 5 is ignited. By blowing downwardly into the intake tube, through opening 21, a draft is initiated through the combustion chamber and out the chimney. The draft is sustained as the heat rises through the combustion chamber, through the chimney, and out top opening 49 of the chimney. More fuel may then be added to provide a large supply of fuel within the intake tube. Air entering and flowing downwardly through the intake tube cools the fuel within the tube to prevent the fuel from reaching kindling temperature. This and the downward flow of air through the intake tube prevents combustion in intake tube 20. At the same time, oxygen is provided for combustion of fuel within the combustion chamber. As fuel is consumed in the combustion chamber, additional fuel enters the combustion chamber from the air-fuel intake tube 20. Fuel within the chamber burns normally, with the heated air and fumes rising to contact the walls and top plate 37 of the combustion chamber; the walls of water flow-through tube 35; and the walls of the chimney, which, by heat transference, warms the water within the tank. It will be noted that first portion 41 of chimney 40 is spaced from side wall 27 of intake tube 20 to allow water flow between the chimney and the intake tube Such structure allows for superior heat transference to the water by the chimney to prevent the chimney from reaching dangerously high temperatures and also serves to cool the intake tube.

Having thus described in detail a preferred embodiment of the present invention, it is to be appreciated and will be apparent to those skilled in the art that many physical changes could be made in the apparatus without altering the inventive concepts and principles embodied therein The present embodiment is therefore to be considered in all respects as illustrative and not restrictive, the scope of the invention being indicated by the appended claims rather than by the foregoing description, and all changes which come within the meaning and range of equivalency of the claims are therefore to be embraced therein

I claim:

1. An immersible water heater for water tanks comprising an elongated, combined air and solid fuel intake tube; means forming a combustion chamber located immediately adjacent in side by side relationship with said intake tube; a chimney mounted vertically over and in communication with a top wall of said combustion chamber, said air-fuel intake tube being substantially vertically oriented, and provided at its upper most end with a top opening for receiving fuel and air, said combustion chamber and fuel intake tube including a common horizontal wall and a common side wall extending from a top of said combustion chamber toward and spaced from said common bottom wall to provide an unobstructed port opening laterally into said combustion chamber for gravity feed of fuel placed within the intake tube to said combustion chamber, and said chimney having a top opening above the level of said top opening of said air-fuel intake tube for providing an air draft, after ignition, operable to cool fuel within said intake tube and to cause combustion of fuel only within said combustion chamber.

2. The heater as described in claim 1 including a water flow-through heat exchanger tube extending through said combustion chamber.

3. The heater as described in claim 1 further comprising a first bracket affixed to said air and fuel intake tube for engaging a top lip of a tank for supporting the heater in a spaced position from the floor and top side of the tank.

4. The heater as described in claim 3 further comprising a second bracket affixed to said air and fuel intake tube adjacent its lowermost end for engaging a bottom side wall of a tank to hold the heater in a spaced position therefrom.

5. The heater as described in claim 1 including means for demounting an upper portion of said chimney from a lower portion of said chimney.

6. An immersible water heater for water tanks comprising:

an elongated, vertically oriented, combined air and fuel intake tube; means forming a tubular combustion chamber in side by side relationship with said intake tube; and a vertically oriented chimney mounted over and in communication with said combustion chamber and parallel with and spaced from said intake tube for water flow therebetween; said intake tube provided at its upper most end with a top opening for receiving fuel and air; said combustion chamber and fuel intake tube including a common horizontal bottom wall and a common side wall extending from a top of said combustion chamber toward and spaced from said common bottom wall to provide an unobstructed port opening laterally into said combustion chamber for gravity feed of solid fuel placed within the intake tube to said combustion chamber, and said chimney having a top opening above the level of said top opening of said air-fuel intake tube for providing an air draft, after ignition, operable to cool fuel within said intake tube and to cause combustion of fuel only within said combustion chamber; and one or more brackets affixed to said air and fuel intake tube, said brackets operable to support said heater housing from the lip of a tank and to prevent said heater housing from contacting a floor and side wall of a tank.

7. The heater as described in claim 6 including a water flow-through heat exchanger tube extending through said combustion chamber.

* * * * *